US005783058A

United States Patent [19]

Fowler et al.

[11] Patent Number: 5,783,058

[45] Date of Patent: Jul. 21, 1998

[54] ANODE ELECTROPLATING CELL AND METHOD

[75] Inventors: H. Kirk Fowler, Madison; Gerald R. Pohto, Mentor; Zane A. Wade, Montville, all of Ohio

[73] Assignee: Eltech Systems Corporation, Chardon, Ohio

[21] Appl. No.: 653,119

[22] Filed: Jun. 6, 1996

Related U.S. Application Data

[60] Provisional application No. 60/001,942 Aug. 7, 1995.

[51] Int. Cl.[6] ..... C25D 5/34; C25D 17/00; C25D 17/10

[52] U.S. Cl. ..... 205/205; 205/261; 205/7; 204/212; 204/290 R; 204/290 F; 204/292; 204/293; 29/825; 427/422

[58] Field of Search ..... 205/134, 261, 205/205, 269, 272, 281, 284, 292, 300, 305, 239, 243, 244, 245, 252, 256; 204/216, 290 R, 290 F; 29/825; 427/422

[56] References Cited

U.S. PATENT DOCUMENTS

| | | | |
|---|---|---|---|
| 2,265,526 | 8/1966 | Beer | 117/50 |
| 3,632,498 | 1/1972 | Beer | 204/290 F |
| 3,711,385 | 1/1973 | Beer | 204/59 |
| 4,318,794 | 3/1982 | Adler | 204/216 |
| 4,340,449 | 7/1982 | Srinivasan et al. | 204/15 |
| 4,528,084 | 7/1985 | Beer et al. | 204/290 F |
| 5,017,275 | 5/1991 | Niksa et al. | 204/206 |
| 5,344,538 | 9/1994 | Chamberlain et al. | 204/290 R |
| 5,393,396 | 2/1995 | DeWitt et al. | 204/206 |
| 5,489,368 | 2/1996 | Suitsu et al. | 204/290 R |
| 5,626,730 | 5/1997 | Shimamune et al. | 204/290 F X |
| 5,628,892 | 5/1997 | Kawashima et al. | 204/290 F |

FOREIGN PATENT DOCUMENTS

| | | |
|---|---|---|
| 1005928 | 3/1994 | Belgium . |
| 0504939 | 3/1992 | European Pat. Off. . |
| 0554793 | 1/1993 | European Pat. Off. . |

*Primary Examiner*—Donald R. Valentine
*Attorney, Agent, or Firm*—John J. Freer; David J. Skrabec

[57] ABSTRACT

An existing, usually used radial lead anode in an electroplating cell is machined to a specific radius. This provides a curved, machined surface for the lead anode to serve as a support structure. A thin gauge, dimensionally stable sheet anode of a multitude of side-by-side strip anodes is formed, with each strip anode being typically formed to a larger radius then the radius of the support structure. The sheet anode strips may be precurved into a series of chords. The strip anodes are flexed into place onto the surface of the lead support structure. Fastening these strips and the support structure together can be accomplished by a series of fastening means attached to the back of each strip anode, which means can project into or through holes in the lead support structure. Electrical connection can be provided, such as through the fastening means, with the lead support structure serving as a current distributor member. The lead support structure, which may be slightly soluble in cell electrolyte, is protected by the sheet anode. Moreover, the sheet anode is readily removable, such as for renovation of an active anode coating.

50 Claims, 2 Drawing Sheets

ANODE ELECTROPLATING CELL AND METHOD

CROSS-REFERENCE TO RELATED APPLICATION

This application claims the benefits of U.S. Provisional application Ser. No. 60/001,942, filed Aug. 7, 1995, and assigned to the assignee of the present application.

BACKGROUND OF THE INVENTION

1. Technical Field

The present invention relates generally to the art of electrodepositing metal, and most usually to electroforming metal foils. The present invention is particularly applicable to preparing copper foil.

2. Description of the Prior Art

Electrodeposited copper foil is generally formed by immersing a rotating drum cathode in an electrolyte solution containing copper ions. A curved anode of electrically conductive material is also immersed in the electrolyte solution and positioned adjacent the drum cathode to define an interelectrode gap therebetween. Copper foil is formed on the rotating drum cathode. The electrodeposited foil is continually removed from the drum cathode as it emerges from the electrolyte solution so as to permit continuous foil production.

For maintaining uniform spacing between anode and cathode,insoluble anodes may be used since non-uniform dissolution of soluble anodes may occur. Lead anodes are widely used in electroforming metal foils, but while lead anodes are commonly referred to as insoluble anodes, they are not truly insoluble. In use, lead dioxide is produced at the surface of the anode and oxygen is liberated from the lead oxide surface rather than at the lead surface. Through continued usage, the lead dioxide is generally dissolved and may flake off thereby increasing the spacing between the anode and cathode. Thus, the lead anodes are at least slightly soluble in the electrolyte.

Dimensionally stable electrodes are well known. The term "dimensionally stable" means that the electrodes are not consumed during use. Typically, a dimensionally stable electrode comprises a substrate and a coating on surfaces of the substrate. In regard to these anodes and electrodeposited foil, U.S. Pat. No. 4,318,794 discloses a radial electrolytic cell for metal winning. A plurality of dimensionally stable, elongated, anode strips are positioned in the cell electrolyte spaced from a cylindrical cathode. The anode strips extend, longitudinally, parallel to the axis of the cathode. Each strip is relatively narrow in width compared to its length, being co-extensive, circumferentially, with only a small surface or arc of the cathode. By employing a plurality of narrow strips, the tolerances to which each strip is rolled become less critical. Typically, the strips are about 2–20 inches in width.

U.S. Pat. No. 5,017,275 discloses an anode structure for an electroplating cell, with the anode structure comprising a resilient anode sheet having an active anode surface, and a support substructure for the anode sheet. The anode substructure has a predetermined configuration that can include a concave surface of a first radius. The anode sheet can be formed with a second radius which is less than the first radius of the substructure. In this way, the anode sheet when placed upon the concave surface can be flexed downwardly and secured to the substructure. In refurbishing the anode assembly, usually only thin coated sheets, which are easily replaced and recoated, need be considered in the refurbishing.

In published European Patent Application 0 554 793 there is disclosed apparatus for the preparation of metal foil, which apparatus includes a stationary arcuate anode placed concentrically with a rotating cathode drum. The anode includes a plurality of circumferentially arranged electrode segments formed of a valve metal material and coated with a platinum group metal or oxide coating. The segments are removably attached and electrically connected to a base plate. The anode is provided in this manner partly for dimensional maintenance of the anode.

For providing an electrically conductive base plate, it has been taught in Belgian Patent No. 1,005,928 that a semicylindrical anode base plate of insoluble titanium can be serviceable. Then, thin plate insoluble metal anodes can be detachably affixed to the titanium base plate. Both these thin metal anodes as well as the conductive base plate have an electrode coating, such as to provide electric current uniformity in a high speed metal foil production operation.

There has also been shown in published European Patent Application 0 484 023 a construction for apparatus for electrodepositing metal wherein the anode assembly is comprised of an anode base having a non-conductive surface. The base, as a cradle, has a predetermined contour facing the cathode and a plurality of deformable metallic anodes. In securing the plurality of deformable metallic anodes to the cradle, the anodes are deformed into engagement with the non-conductive surface.

It would be desirable to provide an electrode assembly which achieves a very uniform fixed gap in a channel between a rotating cathode drum and a stationary arcuate anode spaced concentrically from the drum. It would further be economically desirable to be able to refurbish an electrodeposition assembly, while maintaining the prior "insoluble" anodes, including such anodes as may not be truly insoluble. It would further be desirable to provide these characteristics while maintaining ease of disassembly of electrode elements and while reducing to eliminating contamination in the electrolyte of any maintained insoluble anodes.

SUMMARY OF THE INVENTION

There is now provided an electrode assembly which achieves a very uniform electrode-to-electrode fixed gap and voltage drop. It is particularly adapted to refurbishing an electrode assembly where there is provided efficient and economical assembly of the electrode elements. In addition to ease of assembly, there is now provided ease of disassembly as when electrode elements are in need of rejuvenation. Although the assembly includes a metallic lead element as a substrate, the assembly reduces or eliminates lead contamination in electrolyte maintained in the electrode gap.

In one aspect, the invention is directed to the method of providing an assembly for the electrodeposition of a metal, which method is particularly adapted for refurbishing the assembly, the assembly having a cathode drum rotating about an axis and partially immersed in an electrolyte, which assembly also has a curved lead anode used in metal electrodeposition, such anode being spaced apart from the cathode with a gap maintained between the cathode and anode for containing the electrolyte, which method comprises:

- machining the lead anode to a machined radius and a freshly machined face to establish a curved support structure of predetermined surface configuration;
- providing holes in the machined face of the lead support structure of machined radius;

providing a thin and resilient, solid and insoluble, light gauge flexible anode sheet with a broad active anode front face and broad back face, the sheet anode comprising a multitude of side-by-side, generally elongated, thin and narrow strip anodes, each of which, as formed have a larger radius than the machined radius of the curved lead support structure;

affixing a series of projecting fastening means to the back face of each strip anode;

introducing such projecting fastening means into the holes in the curved lead support structure;

flexing the strip anodes into flexed conforming engagement with the support structure, the resulting anode sheet broad back face being in flexed engagement with the machined face of the lead support structure;

fastening the strip anodes with the projecting fastening means, while in the flexed configuration, to the lead support structure; and electrically connecting the anode sheet and the lead support structure, the support structure serving as a current distributor member for the anode sheet.

In another aspect, the invention is directed to an apparatus for electrodepositing a metal, the apparatus having a cathode drum rotating about an axis and providing an outer plating surface partially immersed in electrolyte, a curved anode spaced from the cathode providing a gap having such electrolyte therein, the anode having an active anode surface and a support structure, the improvement comprising:

a perforated, stationary and rigid lead support structure, at least slightly soluble in the electrolyte, and having a curved upper surface of a first radius;

a thin and resilient, solid and insoluble light gauge flexible anode sheet having a broad active anode front face and broad back face, such light gauge sheet anode comprising a multitude of side-by-side, generally elongated thin and narrow strip anodes, each of which has a formed first configuration of larger radius than the radius of the curved lead support structure, and a supported second configuration on the support structure which is different from the formed first configuration;

fastening means affixed to the back face of each sheet anode strip for detachably securing the strip anodes to the support structure by the fastening means protruding into perforations in the lead support structure, such fastening means providing flexed engagement for the back face of the anode sheet with the upper curved surface of the support structure; and power supply means providing electrical power to the support structure to serve as an electrically conductive current distributor member for such anode sheet.

In yet a further aspect, the invention is directed to a thin strip anode of light gauge strip that is a precurved anode sheet. More particularly, in this aspect, the invention is directed to a generally elongated, thin and resilient, solid and insoluble light gauge flexible metallic strip anode adapted to be detachably fixed to the curved upper surface of a stationary and rigid lead support structure, with a multitude of the strip anodes forming a flexible anode sheet engaged on the curved upper surface of the lead support structure, which lead support structure is spaced apart from a cylindrical roller cathode that is rotatable about a horizontal axis, such strip anode comprising:

a generally elongated, thin, narrow and resilient, solid and insoluble, light gauge and flexible metallic strip that is at least substantially curved in the width dimension of the strip to generally conform to the curved upper surface of the lead support structure, with the curving in the width direction provided by a series of chords separated on an active front face of the strip anode by break lines and on an obverse back face by nodes, providing a plurality of generally elongated, thin metallic chords for each strip anode; and at least one fastening means extending from the back face for detachably securing the strip anode to the curved upper surface of the lead support structure.

The invention is most particularly useful where a curved lead anode that has already been used in metal electrodeposition is machined to a new radius as well as the above-mentioned freshly machined face and then the flexible anode is flexed onto the face of the new radius.

Particularly regarding this machined face lead anode structure, the invention is further directed to an electrode structure comprising a lead anode as a support structure having a broad, curved upper face and a multitude of strip anodes detachably secured to the curved upper face of the support structure, wherein the lead anode curved upper face is coated.

DESCRIPTION OF THE PREFERRED EMBODIMENTS

The electrolytic cells employing the present invention are particularly useful in an electroplating process in which a deposit of a metal, such as copper, is made onto a rotating cathode drum. An example of such a process is the production of electrodeposited foil, for instance copper foil used in the production of printed circuits for electronic and electrical equipment. The copper foil is electrodeposited from an electrolyte onto the surface of a rotating cathode, such as a cathode drum that can be rotatably mounted on an axial supporting shaft that spaces the drum apart from an anode. The foil emerges from the electrolyte and is stripped from the surface of the cathode, and is wound in the form of a coil onto a roll, all in a known manner.

However, these electrolytic cells can also be used in other electrodeposition processes, including electrowinning, e.g., of copper or cobalt, and including for instance plating other metals such as zinc, cadmium, chromium, nickel, tin and metal alloys such as nickel-zinc, onto a substrate, an example of which is electrogalvanizing in which zinc is continuously galvanized onto a strip fed from a steel coil. Another electrodeposition process is surface treating foil, for instance copper foil, previously manufactured.

A cell utilizing the present invention can also be used in non-plating processes such as electromachining, electrofinishing, anodizing, electrophoresis, and electropickling. In prior use, the anode of the electrolytic cell is a lead anode, including anodes of lead and alloys of lead, such as lead alloyed with tin, silver, antimony, calcium and strontium. Such an anode is usually somewhat soluble in the electrolyte of the cell, e.g., at least slightly soluble, and this solubility can lead to contamination of the cathode deposit and variation in the anode-to-cathode gap during operation, providing undesirably elevated operating voltages.

Figure 1:
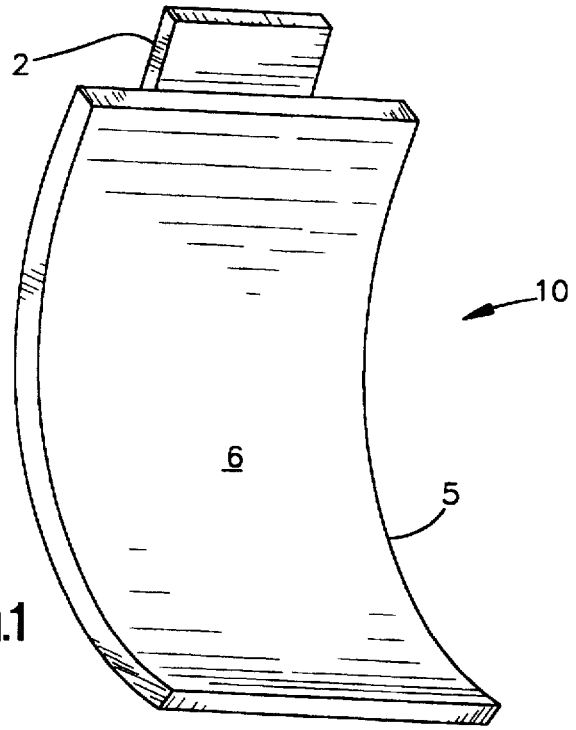
FIG. 1 is a perspective view of a used lead electrode for serving as a support structure according to the present invention.

Referring then to the figures, FIG. 1 depicts an electrode structure 10, which will serve in the electrodeposition apparatus as a support structure 10, comprised of a lead plate 5. The plate 5 may be a single, solid plate. The plate 5 is a lead anode which is to be placed in service, and usually has been used in service, in an electrolytic cell such as in an above described electroplating process. The plate 5 provides an arcuate, or curved, electrode upper surface 6, sometimes referred to herein as the "face" 6. Particularly for a used lead plate 5, this is a freshly machined face 6 machined to a radius of a predetermined surface configuration. This curved electrode upper surface 6 can thus be configured concentrically with a cylindrical cathode drum (not shown). The drum rotates about a center axis so that the outer surface of the drum maintains a constant gap with the face 6 of the plate 5. The plate 5 is of lead or lead alloy, as has been described hereinabove. A power supply means (not shown) is connected to the plate 5 through a busbar 2.

Figure 2:
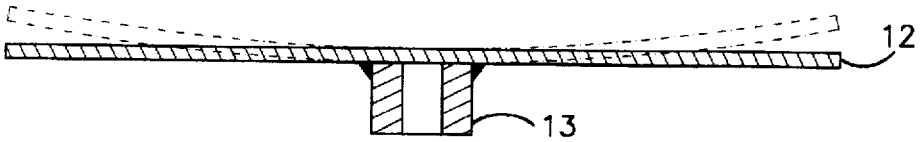
FIG. 2 is a section view depicting an anode of light gauge strip flexed in its width dimension for conforming to the curved upper surface of the support structure of FIG. 1.

Referring then to FIG. 2, a thin and resilient strip anode 12 can be rolled to a flat, or to a near flat configuration having a larger radius than the surface 6, as shown by the solid lines in FIG. 2. This representative strip anode 12 has a short stud 13, in the nature of a boss, affixed as by threading, or other conventional metal-to-metal bonding means such as welding, e.g., friction, TIG or resistance welding, to the back face of the strip anode 12. The resilient strip anode 12 is thin and of a light gauge sheet, which sheet can be one to 20 millimeters (mm) thick. The strip anode 12 is flexible and can be flexed in its width direction into the configuration shown in phantom lines in FIG. 2. These thin and resilient strip anodes 12 may be referred to herein for convenience as "light gauge strips" 12, or "flexible strips" 12. Alternatively, the strip anode 12 may be rolled to a target radius, providing in rolling a configuration for the anode shown in the phantom lines in FIG. 2, which target radius is to at least substantially match or exceed the curvature of the surface 6 on a lead support structure 10 (FIG. 1). Such a strip 12 of target radius may also be formed using heated discs, or the strip 12 could be rolled and then creep flattened on a mandrel. Whether the strip anode 12 is at a near flat configuration or prepared to a target radius, the strip anode 12 can be expected to be formed to a larger radius than the machined radius for the curvature of the surface 6 of the lead plate 5.

Figure 2A:
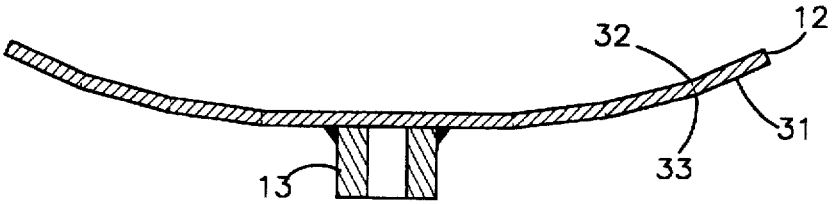
FIG. 2A is a section view of an anode of light gauge strip that is precurved in its width dimension as a series of chords.

Referring then to FIG. 2A, a flexible strip anode 12, as a variation, can be precurved in its width direction into a series of chords 31 such as by pressing the light gauge strip 12 in a press break. Adjacent chords 31 are separated on the upper surface of the strip 12 at break lines 32. Each adjacent anode chord 31, e.g., having a radius resulting from bending, meets at the undersurface of the strip anode 12 at undersurface nodes 33. At the center of the undersurface, the anode plate 12 has a boss 13 affixed thereto. The strip anode 12 has been formed to a larger radius than the radius for the curvature of the surface 6 of the lead plate 5 (FIG. 1).

Figure 3:
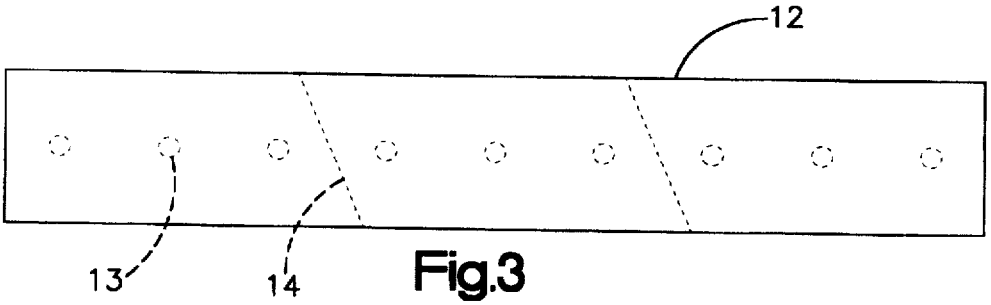
FIG. 3 is a plan view of the front face of a generally elongated light gauge sheet anode strip with optional bias cut anode segments along the anode length.

Details of a variation along the length of a narrow strip anode 12 is depicted in FIG. 3 showing the front face of a strip anode 12. Essentially, this strip anode 12 of thin gauge sheet is a narrow anode, providing an elongated rectangular strip anode 12. The strip anode 12 on its undersurface, or obverse back face, has a plurality of spaced-apart short studs 13 (FIG. 2) shown in FIG. 3 in phantom lines. The studs 13, as shown in the figure, can be all aligned on the center-line of the strip anode 12. However, it is contemplated that these studs 13 need not be aligned on the center-line of the strip anode 12. In the embodiment depicted in FIG. 3, the generally elongated anode plate in its length dimension is segmented and the segments are separated by lines of separation 14 that are biased, e.g., biased with respect to the direction of travel of a cathode drum (not shown). Usually, the strip anodes 12 are solid, i.e., non-perforate, and free from bias or other cutting.

Figure 4:
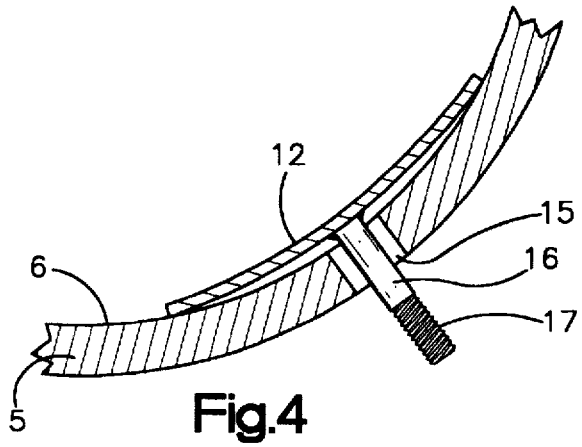
FIG. 4 is a cross-sectional view showing the initial engagement of a light gauge strip anode in contact with a portion of the support structure of FIG. 1.

Referring then to FIG. 4, the light gauge strip anode 12, of at least substantially uniform thickness, is brought into contact with the machined surface face 6 of the lead plate 5. To accomplish this, holes 15 are first drilled through the base plate 5. In the embodiment depicted in FIG. 4, as a variation to the short stud 13 shown in FIG. 2, there is used a long stud 16 which has been affixed, as by welding, to the back of the strip anode 12. The body of the stud 16 proceeds through a hole 15 in the plate 5 and the stud 16 can be connected to a current lead (not shown) such as at a threaded end 17 of the stud 16.

Figure 5:
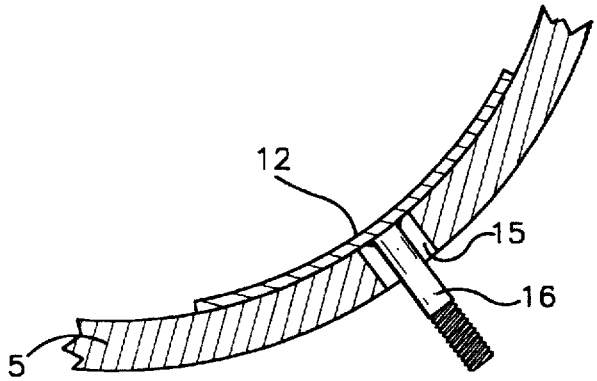
FIG. 5 is a cross-sectional view of the elements of FIG. 4 with the light gauge strip anode pulled into conforming engagement with the support structure.

Then as shown in FIG. 5, the stud 16 has been pulled through the hole 15 whereby the light gauge strip anode 12 flexes into a matching radius with the machined surface face 6 (FIG. 1) of the base plate 5. This base plate 5 may also serve as a current distributor for the strip anode 12. In addition to using a multitude of short studs 13 (FIG. 3), or of long studs 16 (FIG. 4), it is contemplated to employ other serviceable fastening means that are known to those skilled in the art and which advantageously are electrically conductive, e.g., countersunk bolts or tapped holes with threaded studs. These bolts may be secured within the plate 5 whereby the holes 15 would not need to penetrate completely through the plate 5.

Where the fastening means are secured to the back of the strip anode 12, such can be by any suitable means for securing metal to metal, which is advantageously a metallic means for enhanced electrical conductivity between the fastening means and the strip anode 12. When this securing includes metallic means, such is preferably welding, e.g., friction welding, TIG welding, resistance welding, laser welding or capacity discharge welding. Any surface area of the fastening means at the back of the strip anode 12, and which may be just the threaded end 17 of the fastening means, may be treated such as for enhanced electrical connection. Coating, e.g., metal plating, can be a serviceable treatment. The plating may include platinum plating, which could be used at a contact area such as the threaded end 17. A coating treatment may also include application of a friction control coating. Thus, the threaded end 17 can be treated with a coating such as a polytetrafluoroethylene-based coating.

Figure 6:
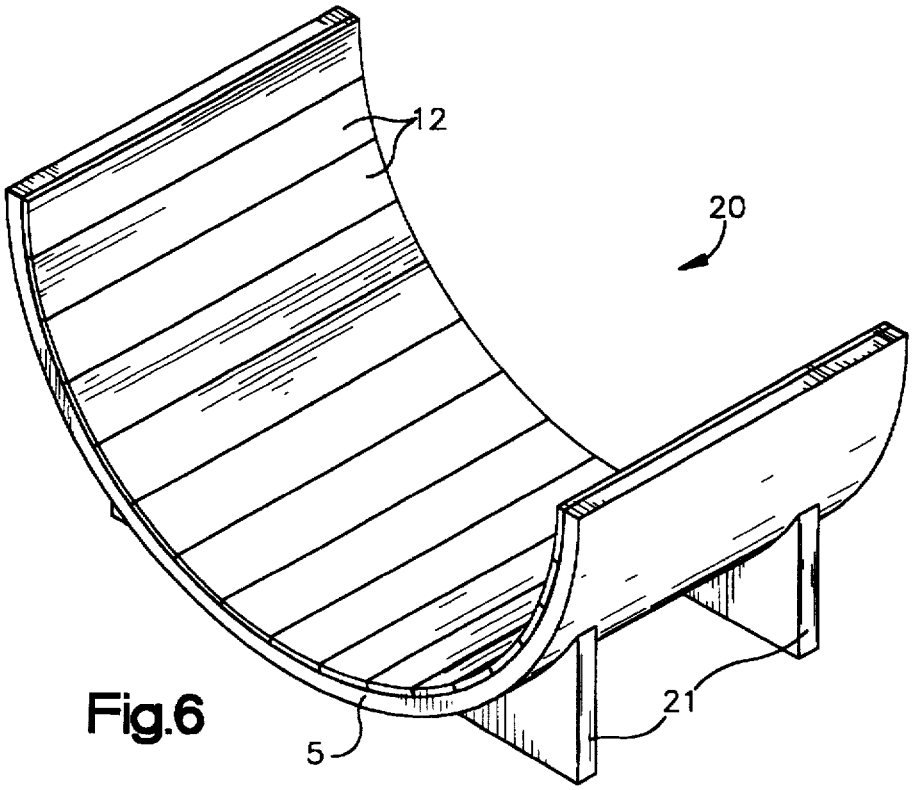
FIG. 6 is a perspective schematic view of a portion of an electrolytic cell having the narrow strip anodes of FIG. 2 in place on the support structure of FIG. 1.

Referring then to FIG. 6, there is shown a representative assembly 20 of an electrodeposition apparatus which has been assembled, e.g., refurbished, in accordance with the present invention. The assembly 20 has a concave lead support plate 5 which is supported by ribs 21. The ribs 21 of the assembly 20 can be supported on beams (not shown) when the electrodeposition apparatus is completely assembled. The support plate 5 supports a multitude of parallel, generally elongated and narrow strip anodes 12 positioned side-by-side across the width of the support plate 5. For this representative assembly 20, seventeen strip anodes 12 are utilized. The active front faces of the strip anodes 12 are exposed to view in FIG. 6. These strip anodes 12 are in side-by-side relationship with contiguous edges in touching engagement. These can be beveled edges. This multitude of strip anodes 12 forms an anode sheet having characteristics of the individual strip anodes 12, e.g., thin and resilient. The back faces (not shown) of the strip anodes 12 are in flexed engagement with the surface 6 (FIG. 4) of the support plate 5, e.g., as by means utilizing studs 16 through base plate holes 15 (FIG. 5).

Each strip anode 12 can be expected to have at least substantially the same thickness, with the thickness being uniform for each strip 12. This electrode assembly 20 comprising the support plate 5 and strip anodes 12, together form a part of a vessel serving as an electrolyte chamber. Around the strip anodes 12 there can be a sealing member, such as a gasket (not shown) to further preclude electrolyte from reaching the support plate 5. Such a sealing member may be of Gore-Tex (trademark) or EPDM (terpolymer elastomer made from ethylene-propylene diene monomer) or the like. Other useful sealing members may be metal coatings, e.g., a thermally spray applied valve metal coating such as of niobium or titanium, or their alloys and intermetallic mixtures, applied by plasma or flame spraying.

In the preparation of the electrode assembly 20, typically a refurbishing operation, the lead substrate plate 5, which may have served in the electrodeposition apparatus as the anode, can be machined down to a new radius. This new radius will provide a curved, freshly machined face 6 for supporting the solid and insoluble, light gauge flexible anode sheet of the multitude of strips 12. In the process, holes 15 can be drilled through the substrate plate 5. Anode strips 12 can have studs 16 secured as by friction welding to the back of the strip anodes 12. The studs 16 are pulled through the holes 15 of the substrate plate 5. The light gauge strip anodes 12 are then flexed in place over the lead substrate plate 5. Contiguous edges of adjacent strip anodes 12 may be beveled for a tight seal. The substrate plate 5 can be connected to a power supply means as through the busbar 2 whereby the lead substrate plate 5 may serve as a current distributor. The strip anodes 12 may also be connected to a power source such as through the studs 16. Although the lead substrate is referred to herein usually as a "plate 5", it will be understood that this is for convenience and that the lead support structure may be in other forms, e.g., a block.

The procedure of assembling the electrode assembly 20 can utilize the precurved strip anodes 12 as shown in FIG. 2A. In this assembly, the principal contact area between the strip anode 12 and the substrate plate 5 can be not only at the stud 13 but also at the undersurface nodes 33. These strip anodes 12 are "at least substantially curved," as the term is used herein, and the curve is in the width dimension of the anode 12. The curve will generally conform to the curved upper surface 6 of the lead plate 5. It is advantageous that the curve of the strip anode 12 have a larger radius than the curve for the upper surface 6 of the lead plate 5. When this precurved strip anode 12 is pulled into place on the substrate plate 5, the precurved strip anode 12 is flexed into place onto the lead substrate plate 5. In the flexing, the undersurface nodes 33 come into firm engagement with the malleable lead support plate 5. This can provide advantageous current connection between the support plate 5 and the strip anode 12. To enhance electrical contact between the nodes 33 and the support plate 5, the nodes could be coated, e.g., coated with a metal such as electroplated with platinum metal. Following flexing, the strip anode 12 will be flexed into place, with the series of chords 31 providing the curve of the strip anode 12.

The lead substrate plate 5 may also be coated, such as with a metal coating, at least on the upper surface 6. This will typically be coating of the freshly machined surface 6 of the plate 5. Where a metal coating is used, such advantageously does not contain platinum group metals, i.e., is a non-platinum group metal coating. For this purpose, these platinum group metals are ruthenium, rhodium, palladium, osmium, iridium and platinum. The coating may be a metal coating such as of copper, nickel, or silver, as well as their alloys and intermetallic mixtures. Suitable means of applying the metal coating include thermal spray application, such as by plasma or flame spraying, e.g., plasma spraying of copper powder.

The strip anodes 12 are thin, i.e., light gauge, and are rolled or otherwise formed elongated strips having sufficient flexibility so that they can be flexed a small amount using reasonable bolting force. The strips 12 should have sufficient thickness to carry current, such as from a current connection to the substrate lead plate 5 serving as a current distributor throughout the total broad obverse face of the whole sheet anode, and sufficient thickness so that the strips 12 are self-supporting and capable of retaining, in the absence of applied force, the shape imparted to them by rolling or other forming. For this, the strip anodes 12 have a thickness of from about 1 to usually about 10 millimeters or more, e.g., up to about 20 millimeters. A thin, coated imperforate titanium strip 12 rolled, or otherwise formed, preferably has a thickness of about 5 to about 10 millimeters (mm).

The strip anodes 12 are insoluble, i.e., not even somewhat or slightly soluble as may be the case for the lead plate 5. The strip anodes 12 are dimensionally stable electrodes. The dimensionally stable electrodes have a solid, i.e., non-perforate, metallic substrate. The substrate is capable of withstanding the corrosive action of the electrolyte in which the strip anodes 12 are immersed, i.e., they are resistant to corrosion from the environment of the strip anodes 12. Materials for the anode substrate, as well as for the studs 16, or other fastening means, e.g., countersunk bolts, are valve metals such as titanium, tantalum, zirconium, niobium, and tungsten. A preferred valve metal is titanium. These metals are resistant to electrolytes and conditions within an electrolytic cell. Hence, the studs 16, or other fastening means, are also resistant to corrosion from the environment.

The valve metals can become oxidized on their surfaces increasing the resistance of the valve metal to the passage of current, thereby passivating the anodes. Therefore, for the active front faces of the strip anodes 12, it is customary to apply electrically conductive electrocatalytic coatings to the anode substrate which then do not become passivated. The anode plates 12 are usually coated before they are installed on the substrate plate 5. As representative of the electrochemically active coatings that may then be applied are those provided from platinum or other platinum group metals or they can be represented by active oxide coatings such as platinum group metal oxides, magnetite, ferrite, cobalt oxide spinel or mixed metal oxide coatings. Such coatings have typically been developed for use as anode coatings in the industrial electrochemical industry. They may be water based or solvent based, e.g., using alcohol solvent. Suitable coatings of this type have been generally described in one or more of the U.S. Pat. Nos. 3,265,526, 3,632,498, 3,711,385 and 4,528,084. The mixed metal oxide coatings can often include at least one oxide of a valve metal with an oxide of a platinum group metal including platinum, palladium, rhodium, iridium and ruthenium or mixtures of themselves and with other metals. Further coatings in addition to those enumerated above include manganese dioxide, lead dioxide, palatinate coatings such as $M_xPt_3O_4$ where M is an alkali metal and X is typically targeted at approximately 0.5, nickel-nickel oxide and nickel plus lanthanide oxides.

The anode substrate for the dimensionally stable electrodes may also be a metal such as steel or copper which is explosively clad or plated with a valve metal, such as titanium clad steel, and then coated, e.g., with an electrocatalytic surface coating.

We claim:

1. The method of providing an apparatus for the electrodeposition of a metal, which method is particularly adapted for refurbishing said apparatus, the apparatus having a cathode drum rotating about an axis and partially immersed in an electrolyte, which apparatus also has a curved lead anode used in metal electrodeposition, said anode being spaced apart from the cathode with a gap maintained between said cathode and anode for containing said electrolyte, which method comprises:

machining the lead anode to a machined radius and a freshly machined face to establish a curved support structure of curved surface configuration;

providing holes in the machined face of said lead support structure of machined radius;

coating the freshly machined face of said support structure with a metal selected from the group consisting of copper, nickel, silver, their alloys and intermetallic mixtures;

providing a thin and resilient, solid and insoluble, light gauge flexible anode sheet with a broad active anode front face and broad back face, said sheet anode comprising a multitude of side-by-side, generally elongated, thin and narrow strip anodes, each of which, as formed, has a larger radius than the radius of said curved lead support structure;

affixing a series of projecting fastening means to the back face of each strip anode;

introducing said projecting fastening means into said holes in the curved lead support structure;

flexing said strip anodes into flexed conforming engagement with said support structure, the resulting anode sheet broad back face being in flexed engagement with the machined face of the lead support structure;

fastening said strip anodes with said projecting fastening means, while in said flexed configuration, to the lead support structure; and electrically connecting said anode sheet and said lead support structure, said support structure serving as a current distributor member for said anode sheet.

2. The method of claim 1 wherein said machining is of a lead anode in solid, unitary form of a metal of lead, or alloy or intermetallic mixture of lead and said anode is at least slightly soluble in said electrolyte.

3. The method of claim 1 wherein said holes are bored completely through said lead support structure.

4. The method of claim 1 wherein the freshly machined face of said support structure is coated prior to introducing said fastening means to said support structure.

5. The method of claim 1 wherein said coating includes applying said metal by means including thermal spraying.

6. The method of claim 1 further including coating the front face of said strip anodes prior to said flexing step.

7. The method of claim 6 wherein said strip anodes are coated with an electrochemically active coating on their front faces.

8. The method of claim 7 wherein said electrochemically active coating contains a platinum group metal, or metal oxide or their mixtures.

9. The method of claim 7 wherein said electrochemically active coating contains at least one oxide selected from the group consisting of platinum group metal oxides, magnetite, ferrite, and cobalt oxide spinel, and/or contains a mixed crystal material of at lest one oxide of a valve metal and at least one oxide of a platinum group metal, and/or contains one or more of manganese dioxide, lead dioxide, platinate substituent, nickel-nickel oxide and nickel plus lanthanide oxides.

10. The method of claim 1 further including sealing said support structure around said sheet anode after fastening of the anode strips.

11. The method of claim 1 wherein there is provided a non-perforate valve metal anode sheet, and said valve metal is selected from the group consisting of titanium, tantalum, niobium, zirconium, tungsten, their alloys and intermetallic mixtures.

12. The method of claim 1 wherein said flexed engagement extends along the total length of said anode sheet.

13. The method of claim 1 further including pressing said thin and narrow strip anodes into a precurved strip having a series of chords providing nodes on the strip anode back face at joints of adjacent chords.

14. The method of claim 13 wherein said flexed engagement flexes said nodes of the strip anode back face into firm engagement with the machined face of said lead support structure.

15. A refurbished electrode assembly made by the method of claim 1.

16. The assembly of claim 15 wherein said assembly is an electrode in a copper, tin, zinc, cadmium, chromium, nickel, or their alloys, electroplating cell or in a copper or cobalt electrowinning cell.

17. In an apparatus for electrodepositing a metal, the apparatus having a cathode drum rotating about an axis and providing an outer plating surface partially immersed in electrolyte, a curved anode spaced from the cathode providing a gap having said electrolyte therein, the anode having an active anode surface and a support structure, the improvement comprising:

a perforated, stationary and rigid lead support structure, at least slightly soluble in said electrolyte, and having a curved upper surface;

a thin and resilient, solid and insoluble light gauge flexible anode sheet having a broad active anode front face and broad back face, said light gauge anode sheet comprising a multitude of side-by-side, generally elongated, thin and narrow strip anodes, each of which has a formed first configuration of larger radius than the radius of said curved lead support structure, and a supported second configuration on said support structure which is different from said formed first configuration;

fastening means affixed to the back face of each strip anode for detachably securing said strip anodes to said support structure by said fastening means protruding into perforations in said lead support structure, said fastening means providing flexed engagement for the back face of said anode sheet with the upper curved surface of said support structure; and power supply means providing electrical power to said support structure to serve as an electrically conductive current distributor member for said anode sheet, with the upper curved surface of said current distributor member having a metal coating of a metal selected from the group consisting of copper, nickel, silver, their alloys and intermetallic mixtures.

18. The apparatus of claim 17 wherein said anode sheet is a valve metal anode sheet and said valve metal is selected from the group consisting of titanium, tantalum, niobium, zirconium, tungsten, their alloys and intermetallic mixtures.

19. The apparatus of claim 17 wherein said thin and narrow strip anodes comprise a multitude of flexible anode strips of at least substantially uniform thickness, which thickness is within the range from about 1 mm to about 20 mm.

20. The apparatus of claim 17 wherein said anode sheet has an electrochemically active coating on said front face.

21. The apparatus of claim 20 wherein said electrochemically active coating contains a platinum group metal, or metal oxide or their mixtures.

22. The apparatus of claim 20 wherein said electrochemically active coating contains at least one oxide selected from the group consisting of platinum group metal oxides, magnetite, ferrite, and cobalt oxide spinel, and/or contains a mixed crystal material of at least one oxide of a valve metal and at least one oxide of a platinum group metal, and/or contains one or more of manganese dioxide, lead dioxide, platinate substituent, nickel-nickel oxide and nickel plus lanthanide oxide.

23. The apparatus of claim 17 wherein said current distributor member is in solid, unitary form and is a metal of lead, or alloy or intermetallic mixture of lead.

24. The apparatus of claim 17 wherein said fastening means comprises a plurality of valve metal means, including studs, said studs are welded to the back face of said strip anodes and said studs are at least partially coated.

25. The apparatus of claim 24 wherein said coating comprises one or more of an electrical contact metal coating, including platinum metal coating, and a friction control coating, including a polytetrafluoroethylene-based coating, and said coating at least coats threaded portions of said fastening means.

26. The apparatus of claim 17 wherein said strip anodes in side-by-side relationship have contiguous edges in touching engagement and said edges are beveled edges.

27. The apparatus of claim 17 further including sealing said current distributor member around said anode sheet by one or more of installing a sealing member, or by application of metal to said current distributor member, which application includes thermal spray application of a valve metal, including application of their alloys and intermetallic mixtures.

28. The apparatus of claim 17 wherein said strip anodes are bias cut into anode segments.

29. The apparatus of claim 17 wherein said strip anodes are light gauge strips precurved into a series of chords.

30. The apparatus of claim 29 wherein said chords provide break lines along the anode front face and nodes along the anode back face.

31. The apparatus of claim 30 wherein said nodes are coated.

32. The apparatus of claim 31 wherein said nodes are coated with a metal and such coating includes electroplated metal.

33. The apparatus of claim 17 wherein said fastening means are electrically conductive and resistant to corrosion from the environment of said fastening means.

34. The apparatus of claim 17 wherein said apparatus is an electrode in a copper, tin, zinc, cadmium, chromium, nickel, or their alloys electroplating cell or in a copper or cobalt electrowinning cell.

35. An electrode structure comprising a lead anode as a support structure having a broad, curved upper face and a multitude of strip anodes detachably secured to said curved upper face of said support structure, wherein said lead anode curved upper face is coated, said coating is a metal coating, and said metal coating is a non-platinum group metal coating and comprises a metal selected from the group consisting of copper, nickel, silver, their alloys and intermetallic mixtures.

36. The electrode structure of claim 35 wherein said curved upper face is a freshly machined face.

37. The method of providing an apparatus for the electrodeposition of a metal, which method is particularly adapted for refurbishing said apparatus, the apparatus having a cathode drum rotating about an axis and partially immersed in an electrolyte, which apparatus also has a curved lead anode used in metal electrodeposition, said anode being spaced apart from the cathode with a gap maintained between said cathode and anode for containing said electrolyte, which method comprises:

machining the lead anode to a machined radius and a freshly machined face to establish a curved support structure of curved surface configuration;

providing holes in the machined face of said lead support structure of machined radius;

providing a thin and resilient, solid and insoluble, light gauge flexible anode sheet with a broad active anode front face and broad back face, said sheet anode comprising a multitude of side-by-side, generally elongated, thin and narrow strip anodes, each of which, as formed, has a larger radius than the radius of said curved lead support structure;

affixing a series of projecting fastening means to the back face of each strip anode;

coating the front face of said strip anodes prior to any flexing step;

introducing said projecting fastening means into said holes in the curved lead support structure;

flexing said strip anodes into flexed conforming engagement with said support structure, the resulting anode sheet broad back face being in flexed engagement with the machined face of the lead support structure;

fastening said strip anodes with said projecting fastening means, while in said flexed configuration, to the lead support structure; and electrically connecting said anode sheet and said lead support structure, said support structure serving as a current distributor member for said anode sheet.

38. The method of providing an apparatus for the electrodeposition of a metal, which method is particularly adapted for refurbishing said apparatus, the apparatus having a cathode drum rotating about an axis and partially immersed in an electrolyte, which apparatus also has a curved lead anode used in metal electrodeposition, said anode being spaced apart from the cathode with a gap maintained between said cathode and anode for containing said electrolyte, which method comprises:

machining the lead anode to a machined radius and a freshly machined face to establish a curved support structure of curved surface configuration;

providing holes in the machined face of said lead support structure of machined radius;

providing a thin and resilient, solid and insoluble, light gauge flexible anode sheet with a broad active anode front face and broad back face, said sheet anode comprising a multitude of side-by-side, generally elongated, thin and narrow strip anodes, each of which, as formed, has a larger radius than the radius of said curved lead support structure;

pressing each strip anode into a precurved strip having a series of chords providing nodes on the strip anode back face at joints of adjacent chords;

affixing a series of projecting fastening means to the back face of each strip anode;

introducing said projecting fastening means into said holes in the curved lead support structure;

flexing said strip anodes into flexed conforming engagement with said support structure, with said flexed engagement flexing said nodes of the strip anode back face into firm engagement with the machined face of said lead support structure, the resulting anode sheet broad back face being in flexed engagement with the machined face of the lead support structure;

fastening said strip anodes with said projecting fastening means, while in said flexed configuration, to the lead support structure; and electrically connecting said anode sheet and said lead support structure, said support structure serving as a current distributor member for said anode sheet.

39. In a generally elongated, thin metallic strip anode adapted to be detachably fixed to the curved upper surface of a stationary and rigid lead support structure, with a multitude of said strip anodes forming a flexible anode sheet engaged on the curved upper surface of the lead support structure, which lead support structure is spaced apart from a cylindrical roller cathode that is rotatable about a horizontal axis, wherein said strip anode comprises a generally elongated, thin, narrow and resilient, solid and insoluble, light gauge and flexible metallic strip that is at least substantially curved in the width dimension of said strip to generally conform to the curved upper surface of said lead support structure, the improvement which comprises:

a strip anode comprising in the width direction a series of chords separated on an active front face of said strip anode by break lines and on an obverse back face by nodes, said break lines and nodes thereby providing generally elongated, thin metallic chords for said strip anode.

40. The anode of claim 39 wherein said thin metallic strip anode is an electrocatalytically coated metal of titanium, tantalum, niobium, zirconium, their alloys or intermetallic mixtures.

41. The anode of claim 39 wherein said thin metallic strip anode, along the length of said anode, is segmented.

42. The anode of claim 39 wherein said strip anode curved to a series of chords has a formed larger radius than the curved upper surface of said lead support structure.

43. The anode of claim 39 wherein said multitude of strip anodes are each, as thin strips, at least substantially of uniform thickness, which thickness is within the range from about 1 mm to about 20 mm.

44. The anode of claim 39 wherein said anode sheet has an electrochemically active coating on said front face.

45. The anode of claim 44 wherein said electrochemically active coating contains a platinum group metal, or metal oxide or their mixtures.

46. The anode of claim 44 wherein said electrochemically active coating contains at least one oxide selected from the group consisting of platinum group metal oxides, magnetite, ferrite, and cobalt oxide spinel, and/or contains a mixed crystal material of at least one oxide of a valve metal and at least one oxide of a platinum group metal, and/or contains one or more of manganese dioxide, lead dioxide, platinate substituent, nickel-nickel oxide and nickel plus lanthanide oxide.

47. The anode of claim 39 wherein said strip anodes, along the length of said anodes, are bias cut into anode segments.

48. The anode of claim 39 wherein said nodes are coated.

49. The anode of claim 48 wherein said nodes are coated with a metal and such coating includes electroplated metal.

50. The anode of claim 39 wherein said anode is an electrode in a copper, tin, zinc, cadmium, chromium, nickel, or their alloys, electroplating cell or in a copper or cobalt electrowinning cell.

* * * * *